US005794302A

United States Patent [19]

Lin

[11] Patent Number: 5,794,302

[45] Date of Patent: Aug. 18, 1998

[54] CAR WASHING BRUSH

[76] Inventor: Yung-Cheng Lin, 439 Chiu Fen Road, Yung Ching Hsiang, Changhua, Taiwan

[21] Appl. No.: 768,944

[22] Filed: Dec. 18, 1996

[51] Int. Cl.[6] ..... B25G 1/06; A46B 5/00

[52] U.S. Cl. ..... 15/172; 15/144.1; 15/229.8

[58] Field of Search ..... 15/144.1, 172, 15/229.4, 229.6, 229.8, 244.2

[56] References Cited

U.S. PATENT DOCUMENTS

| | | | |
|---|---|---|---|
| 2,929,087 | 3/1960 | Salmon | 15/144.1 |
| 3,619,846 | 11/1971 | Krusche et al. | 15/172 |
| 4,673,307 | 6/1987 | Prestele et al. | 15/172 |

FOREIGN PATENT DOCUMENTS

| | | | |
|---|---|---|---|
| 2207858 | 2/1989 | United Kingdom | 15/172 |

*Primary Examiner*—Terrence Till

*Attorney, Agent, or Firm*—Beveridge, DeGrandi, Weilacher & Young, LLP

[57] ABSTRACT

A car washing brush is composed of a head, a holding plate, and a handle. The head is held by the holding plate and is provided with the bristles attached thereto securely for bringing about the brushing effect. The handle is fastened pivotally at one end thereof with the holding plate by a fastening device enabling the handle to be rotated in relation to the holding plate at such time when a press button of the handle is pressed by the finger of a person using the washing brush. The extension of the handle is therefore attained.

6 Claims, 4 Drawing Sheets

CAR WASHING BRUSH

FIELD OF THE INVENTION

The present invention relates generally to a washing brush, and more particularly to a washing brush designed for use in washing a car.

BACKGROUND OF THE INVENTION

The conventional car washing brush is generally very helpful in cleaning the external surface of the body of a car; nevertheless it is defective in design in that it requires its user to relocate often in the midst of washing the car, and that it is incapable of allowing its user to reach easily the center of the car roof, and further that it is not suitable for use in washing the windows of a house or building.

SUMMARY OF THE INVENTION

The primary objective of the present invention is to provide a washing brush, which is designed primarily for use in washing a car and is also suitable for use in washing the windows and the walls of a house or building, as well as furniture and decorative items.

The foregoing objective of the present invention is attained by a car washing brush which is composed of a head, a holding plate for retaining the head, and a handle fastened at one end thereof with the holding plate. The head is provided with a number of bristles attached thereto for bringing about the brushing effect. The handle is fastened pivotally with the holding plate such that the handle can be adjustable rotated to give an added length to the car washing brush.

The foregoing objective, features, functions, and advantages of the present invention will be more readily understood upon a thoughtful deliberation of the following detailed description of an embodiment of the present invention in conjunction with the accompanying drawings.

DETAILED DESCRIPTION OF THE EMBODIMENT

Figure 1:
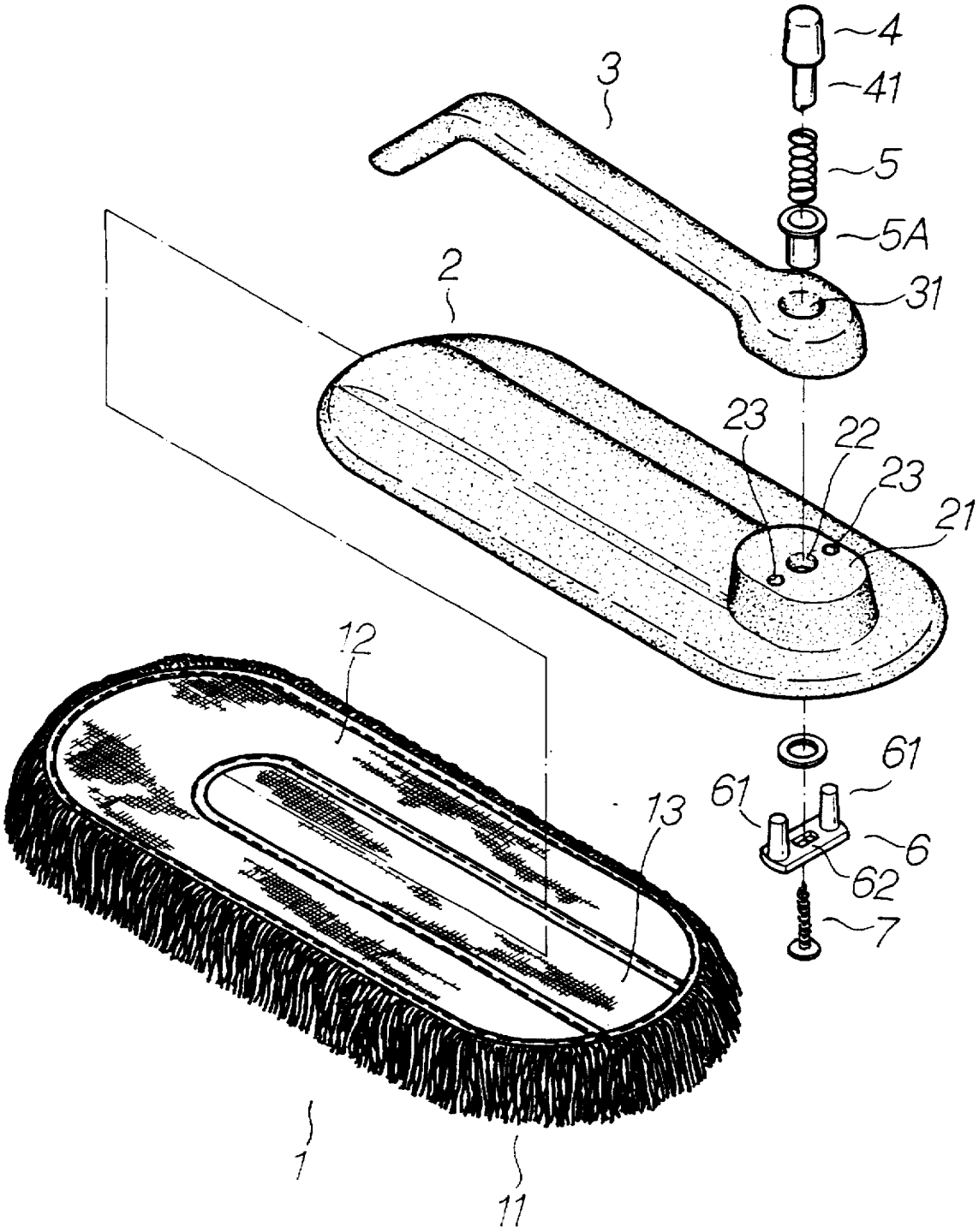
FIG. 1 shows an exploded view of a car washing brush of the embodiment of the present invention.

As shown in FIG. 1, the car washing brush embodied in the present invention is composed of a head 1, a holding plate 2, and a handle 3.

The head 1 is of an oblong construction and is provied in the underside thereof with a number of bristles 11 attached thereto securely for bringing about the brushing effect. The head 1 is further provided in an upper side 12 thereof with a receiving recess 13 in which the holding plate 2 is secured.

The holding plate 2 is provided at the longitudinal end of the upper side thereof with a retaining projection 21 made integrally therewith for fastening pivotally one end of the handle 3. The retaining projection 21 is circular in its cross section and is provided with a fastening hole 22 and lower portions 23B of two locating holes 23 which are located oppositely on both sides of the fastening hole 22 in such a manner that the two locating holes 23 are aligned with the fastening hole 22.

Figure 2:
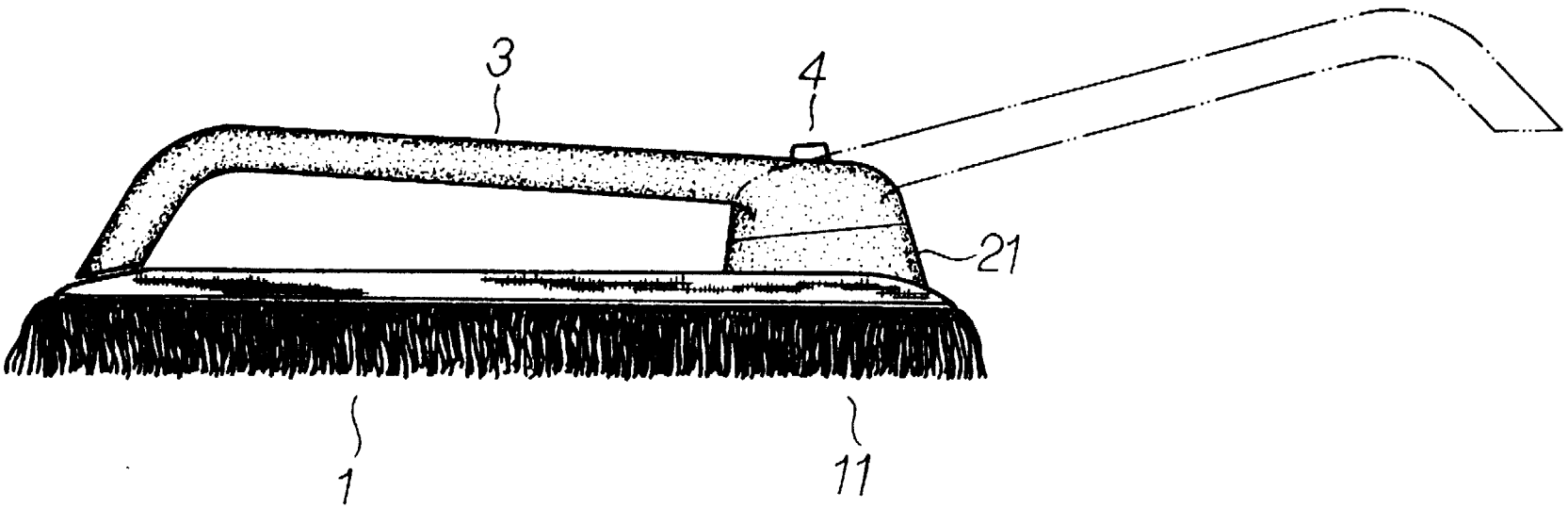
FIG. 2 is a front view of the present invention in combination to show that the handle of the present invention is rotated for an angle of 180 degrees.
Figure 3:
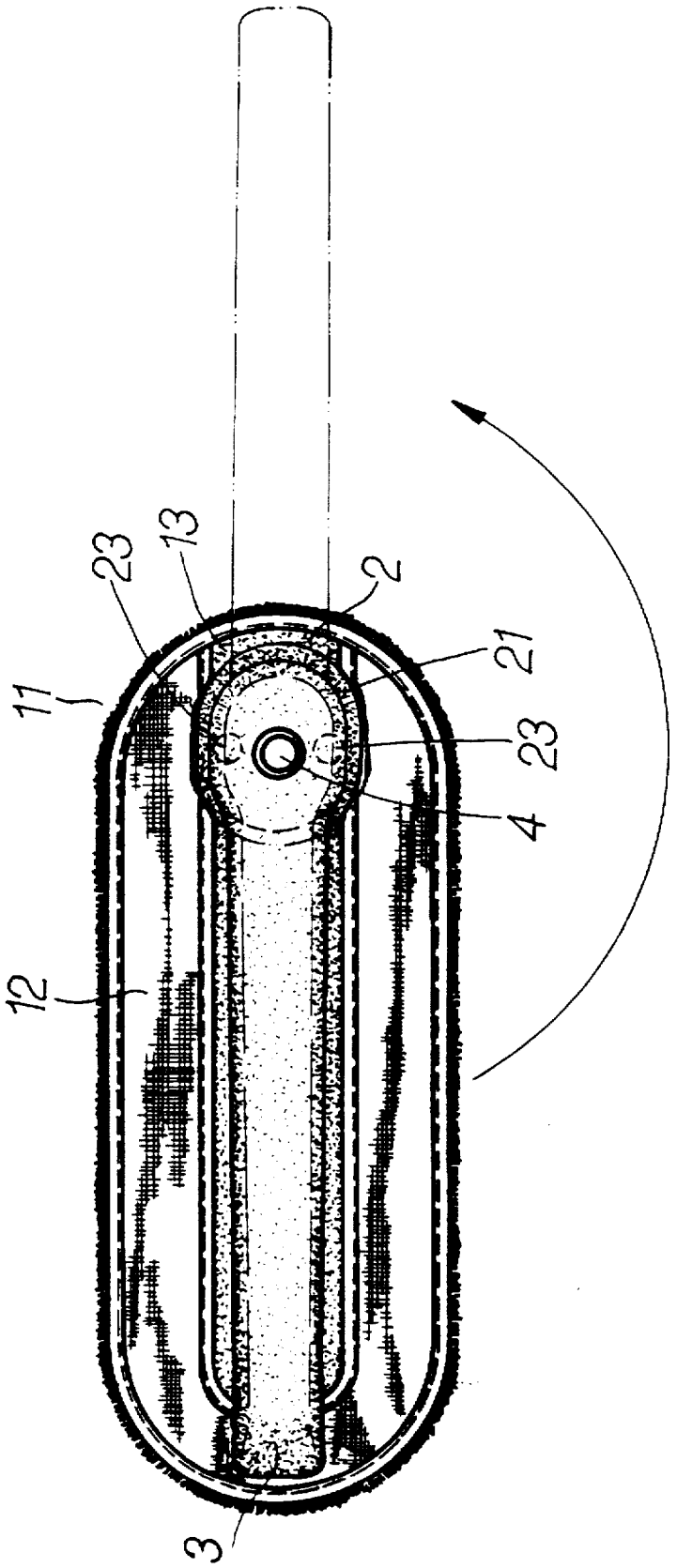
FIG. 3 is a top view of the present invention as shown in FIG. 2.
Figure 5:
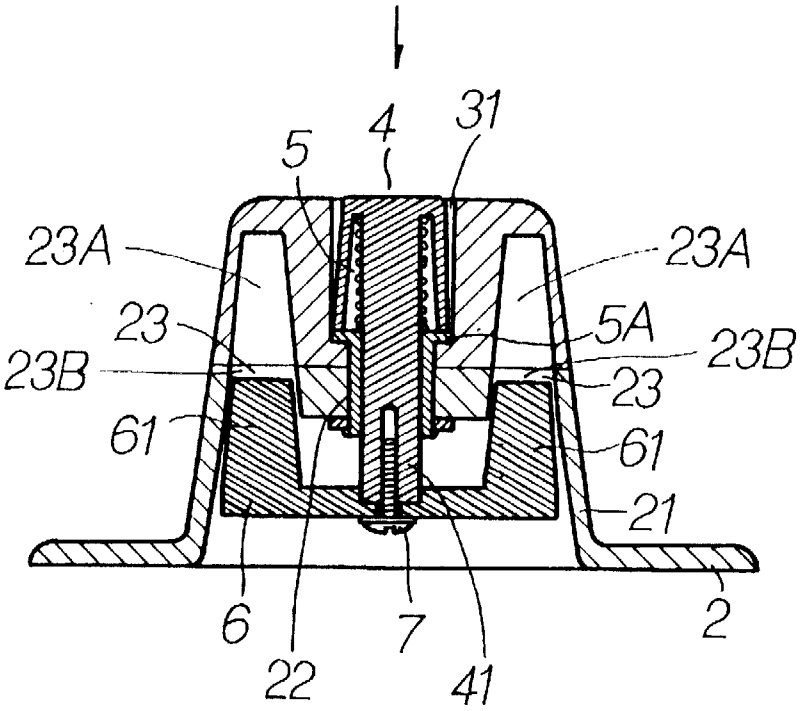
FIG. 5 shows a schematic view of the operation of the press button of the present invention.
Figure 4:
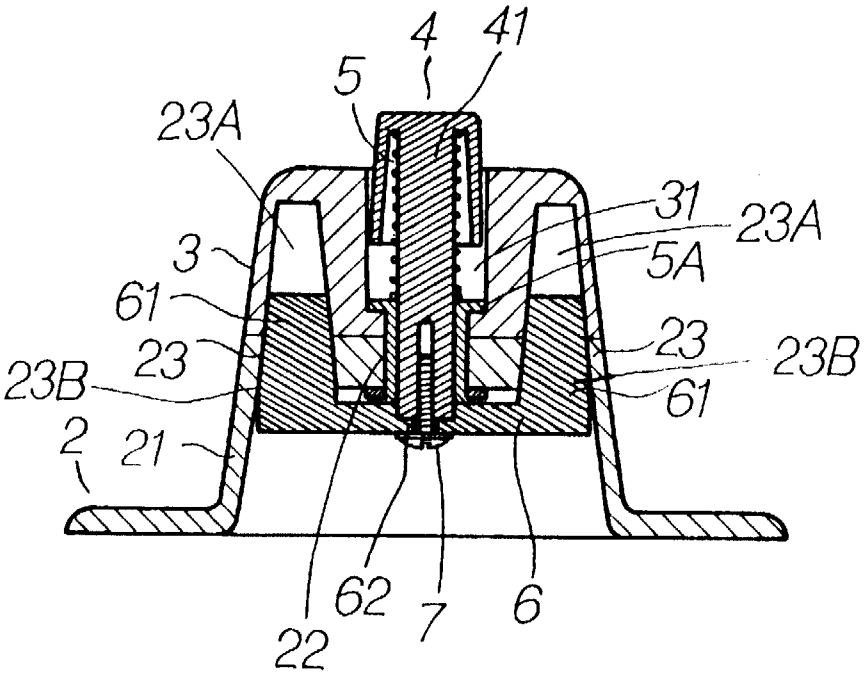
FIG. 4 shows a schematic view of the construction of a press button of the present invention.

The handle 3 is provided at one end thereof with a pivoting hole 31 corresponding in location to the fastening hole 22 of the holding plate 2 and upper portions 23A of the two locating holes 23. In other words, the handle 3 is fastened pivotally at one end thereof with the retaining projection 21 of the holding plate 2. The pivoting hole 31 is provided therein with a sleeve 5A in which a coil spring 5 and a press button 4 are located. The press button 4 has an elongated body 41 which is fitted into the coil spring 5 and is provided with a threaded hole (not shown in the drawing). The fastening of the handle 3 with the retaining projection 21 of the holding plate 2 is attained by a fastening device 6 of a rectangular construction. The fastening device 6 comprises two locating projections 61 engageable with the two locating holes 23 of the retaining proojections 21 of the holding plate 2. The fastening device 6 further comprises a bolt hole 62, which is located between the two locating projections 61 and is engageable with a fastening bolt 7 which is in turn engageable with the threaded hole of the body 41 of the press button 4. In combination, the handle 3 is rotatably fastened with the holding plate 2 such that the locating projections 61 of the fastening device 6 are caused to disengage the upper portion 23A of the locating holes 23 and be positioned in the retaining projection 21 of the holding plate 2 when the press button 4 is pressed, as illustrated in FIGS. 4 and 5. Whenever the extension of the handle 3 is called for, the press button 4 is pressed so as to allow the handle 3 to turn, as indicated by the dotted lines in FIGS. 2 and 3. Upon completion of the rotation of the handle 3, the press button 4 is relieved of the pressure exerting thereon, so as to allow the locating projections 61 of the fastening device 6 to extend outward from the surface of the rim of locating holes 23 of the retaining projection 21 of the holding plate 2 and be received in the upper portions 23A thereof defined in the handle 3.

The car washing brush of the present invention described above is intended for use in washing a car; nevertheless it is also suitable for use in washing the walls and the windows of a house or building, furniture, decorative articles, etc.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claim.

What is claimed is:

1. A washing brush, comprising:

a brush head having a receiving recess defined in an upper side thereof;

a holding plate secured in said receiving recess of said head and provided at one end of an upper side thereof with a retaining projection, said retaining projection defining a fastening hole and two locating holes;

a handle having defined at one end thereof a pivoting hole;

a sleeve member provided in said pivoting hole;

biasing means received in said sleeve;

a press button engaged with said biasing means; and a fastening device provided with two locating projections removably received in and removably extending out of said two locating holes of said retaining projection of said holding plate, said fastening device being coupled with said press button, wherein said fastening device couples said one end of said handle with said retaining projection of said holding plate such that said two locating projections of said fastening device extend from said two locating holes of said retaining projection of said holding plate and engage said handle, said handle is rotatable when said press button of said handle is displaced by an external force to remove said two locating projections of said fastening device from said handle.

2. A handle apparatus for a brush, comprising:

a holding plate having a retaining portion defined thereby, said retaining portion defining lower portions of a plurality of locating holes;

a handle member rotatably engaged with said holding member, said handle member defining upper portions of said locating holes, said upper and said lower portions of said locating holes aligning to form said locating holes when said holding plate and said handle member are disposed in first and second relative rotational positions; and a fastening device having two locating projections, said two locating projections being at least partially received in said bottom portions of said locating holes.

3. The handle apparatus defined by claim 2, further comprising:

biasing means for removably biasing said two locating projections of said fastening device at least partially in said upper portions of said locating holes when said holding plate and said handle member are in said first or said second relative rotational positions, thereby releasably fixing said holding plate relative to said handle member.

4. The handle apparatus defined by claim 3, wherein:

said first relative rotational position defines an extended position of said handle member and said second relative rotational position defines a non-extended position of said handle member.

5. The handle apparatus defined by claim 4, wherein:

said holding plate is engagable with a brush head.

6. An extendable brush apparatus, comprising:

a brush head having a recess defined therein;

a holding plate having a portion received in said recess of said brush head, said holding plate defining two first locating holes;

a handle rotatably coupled to said holding plate and defining two second locating holes; and a fastening device having two locating projections, each of said two locating projections being received in one of said first locating holes and one of said second locating holes.

* * * * *